US008517706B2

(12) United States Patent
Lurtz

(10) Patent No.: US 8,517,706 B2
(45) Date of Patent: Aug. 27, 2013

(54) NON-ECCENTRIC ENGINE

(76) Inventor: Jerome R. Lurtz, Oakland, MI (US)

( * ) Notice: Subject to any disclaimer, the term of this patent is extended or adjusted under 35 U.S.C. 154(b) by 336 days.

(21) Appl. No.: 12/955,205

(22) Filed: Nov. 29, 2010

(65) Prior Publication Data

US 2011/0135525 A1 Jun. 9, 2011

Related U.S. Application Data

(60) Continuation-in-part of application No. 11/689,110, filed on Mar. 21, 2007, now Pat. No. 7,841,082, which is a continuation-in-part of application No. 11/342,772, filed on Jan. 30, 2006, now abandoned, which is a division of application No. 10/426,419, filed on Apr. 30, 2003, now abandoned.

(60) Provisional application No. 60/380,101, filed on May 6, 2002.

(51) Int. Cl.

| | |
|---|---|
| ***F01C 21/10*** | (2006.01) |
| ***F03C 2/00*** | (2006.01) |
| ***F03C 4/00*** | (2006.01) |
| ***F04C 2/00*** | (2006.01) |

(52) U.S. Cl.

USPC ..... 418/150; 418/196

(58) Field of Classification Search

USPC ..... 418/150, 191, 196, 227; 123/232–246

See application file for complete search history.

(56) References Cited

U.S. PATENT DOCUMENTS

| | | | | |
|---|---|---|---|---|
| 1,052,045 | A * | 2/1913 | Doedyns | 418/196 |
| 2,920,610 | A * | 1/1960 | Breelle | 123/246 |
| 3,955,903 | A * | 5/1976 | de Dobo | 418/61.3 |
| 4,457,680 | A * | 7/1984 | Paget | 418/191 |
| 6,129,067 | A * | 10/2000 | Riley | 123/246 |

FOREIGN PATENT DOCUMENTS

| | | | |
|---|---|---|---|
| WO | WO 91/02888 A1 * | 8/1990 | 418/196 |

* cited by examiner

*Primary Examiner* — Theresa Trieu

(74) *Attorney, Agent, or Firm* — Simmons Perrine Moyer Bergman PLC

(57) ABSTRACT

The present invention is an apparatus that includes a chamber rotor with a chamber and an extension rotor with an extension. The rotors are housed in a rotor case. A pressure cavity is at least transiently formed by the extension rotor and the chamber rotor. The present invention also includes a compressor that includes a chamber rotor with a chamber and an extension rotor with an extension where the extension is adapted to be received in the chamber when the rotors are synchronously rotated. The compressor also includes a power input shaft attached to the extension rotor and a gear assembly attached to the rotors that is adapted to insure the synchronous rotation of the rotors. A rotor case houses the rotors and has an intake port and an exhaust port. The present invention also includes an engine that is similar to the compressor and includes a spark plug. Methods of compressing, pumping and generating electricity and mechanical power are also part of the present invention.

12 Claims, 14 Drawing Sheets

NON-ECCENTRIC ENGINE

RELATED APPLICATIONS

This application is a continuation-in-part of U.S. patent application Ser. No. 11/689,110, filed Mar. 21, 2007, which is a continuation-in-part of U.S. patent application Ser. No. 11/342,772, filed on Jan. 30, 2006, which is a divisional of U.S. patent application Ser. No. 10/426,419, filed on Apr. 30, 2003, which in turn claims benefit of U.S. provisional application No. 60/380,101, filed May 6, 2002.

FIELD OF THE INVENTION

This invention relates to improved non-eccentric devices such as pumps, compressors, and especially engines.

BACKGROUND OF THE INVENTION

Engines provide a generally effective method of converting chemical energy into mechanical energy; they may turn fossil fuels into power that can drive the wheels of an automobile or the propeller of a boat. There are two general types of engines: piston engines and turbine engines. Piston engines are very common and have been adapted to numerous tasks. They provide relatively high amounts of torque or drive power, while being of a medium weight. Piston engines have numerous drawbacks including having many moving parts, having poor fuel efficiency, and being the root cause of significant amounts of pollution, while also being costly to assemble. Piston engines utilize a to-and-fro motion of the piston to generate torque. Consequently, piston engines are termed eccentric. Their eccentric nature is the cause of many of their inefficiencies.

Turbine engines are also common, particularly in aircraft. Known turbine engines operate by forcing a fluid (gas or liquid) through the engine, thus turning the fan-blades of the turbine. Known turbines may be characterized as momentum turbines because they operate by transferring the momentum of the fluid to the fan blades of the turbine. The hallmark of a momentum turbine is that if the rotation of the fan blades is prevented, the flowing fluid will continue to flow through the engine around the fan blades. Essentially no back pressure is created through the engine.

Known turbine engines have desirably high power to weight ratios, but have poor fuel efficiency, are difficult to cool and have short operational life spans given the extreme operating conditions. Also, turbine engines are generally unsuitable for use in ground vehicles because of the complex transmission required to translate the high speed of the turbine into the low speed of the vehicle wheels. Because turbine engines utilize pure rotary motion of the fan blades to generate torque, turbine engines are termed non-eccentric engines.

A Wankel engine combines some of the advantages of piston engines and turbine engines but sacrifices fuel efficiency and torque, which are both quite poor. Wankel engines use a single rotor and an eccentric shaft that wobbles the rotor.

Known compressors/pumps include gear pumps and lobe pumps. Although they utilize rotors and rotary motion, these types of compressors/pumps have several drawbacks. Effectively, gear/lobe pumps accomplish pumping by drawing fluid from one reservoir and transporting it to another reservoir. They may be characterized as one-way transporting valves. At no point do the rotors cooperate to compress or pump the fluid. In addition, they are inefficient and have relatively poor rates of pumping/compression. Also, gear and lobe pumps cannot be adapted for use as an engine. An example of a non-eccentric pump is in development by Star Rotor Corporation (College Station, Tex.).

Although non-eccentric, rotary engines may be known, such engines require extra seals in addition to the rotors to provide effective compression of the air/fuel mixture before combustion and effective transference of power from the combustion products. To achieve effective compression through the use of only the rotors, the rotors need to be constructed to tolerances on the order of a few ten-thousandths of an inch. Known techniques for designing the rotors (e.g. scribing as found in U.S. Pat. No. 2,920,610) cannot provide the necessary tolerances. Indeed, to this point tolerances of a few hundredths of an inch were all that was possible. Such tolerances will not provide sealing between the rotors. Moreover, rotors constructed to tolerances of a few hundredths of an inch have a high risk of being misshapen to a degree that the rotor will collide with each other during rotation, which is unacceptable.

The inventor provides a method for designing and constructing rotors having the necessary tolerance to provide sealing, but avoiding collision of the rotors during rotation.

SUMMARY OF THE INVENTION

The present invention is an apparatus that includes a chamber rotor with a chamber and an extension rotor with an extension. The rotors are housed in a rotor case. A pressure cavity is at least transiently formed by the extension rotor and the chamber rotor. The present invention also includes a compressor that includes a chamber rotor with a chamber and an extension rotor with an extension where the extension is adapted to be received in the chamber when the rotors are synchronously rotated. The compressor also includes a power input shaft attached to the extension rotor and a gear assembly attached to the rotors that is adapted to insure the synchronous rotation of the rotors. A rotor case houses the rotors and has an intake port and an exhaust port. The present invention also includes an engine that is similar to the compressor and includes a spark plug. Methods of compressing, pumping and generating electricity and mechanical power are also part of the present invention.

Furthermore, methods of constructing the rotors are included in the invention. Such methods include machining rotor blanks according a set of formulas that describe the extension walls of the extension rotor and describe the chamber wall of the chamber rotor. In addition, the invention includes engines, compressors and pumps with rotors made according to the disclosed methods.

DETAILED DESCRIPTION

The present invention is a non-eccentric, internal combustion engine that can be used in place of traditional engines including piston engines, turbine engines, and Wankel engines. Furthermore, the present invention is also a high efficiency compressor that may be used in place of traditional compressors. The present invention may also be used as a pump for vapor, liquid or both.

Figure 1:
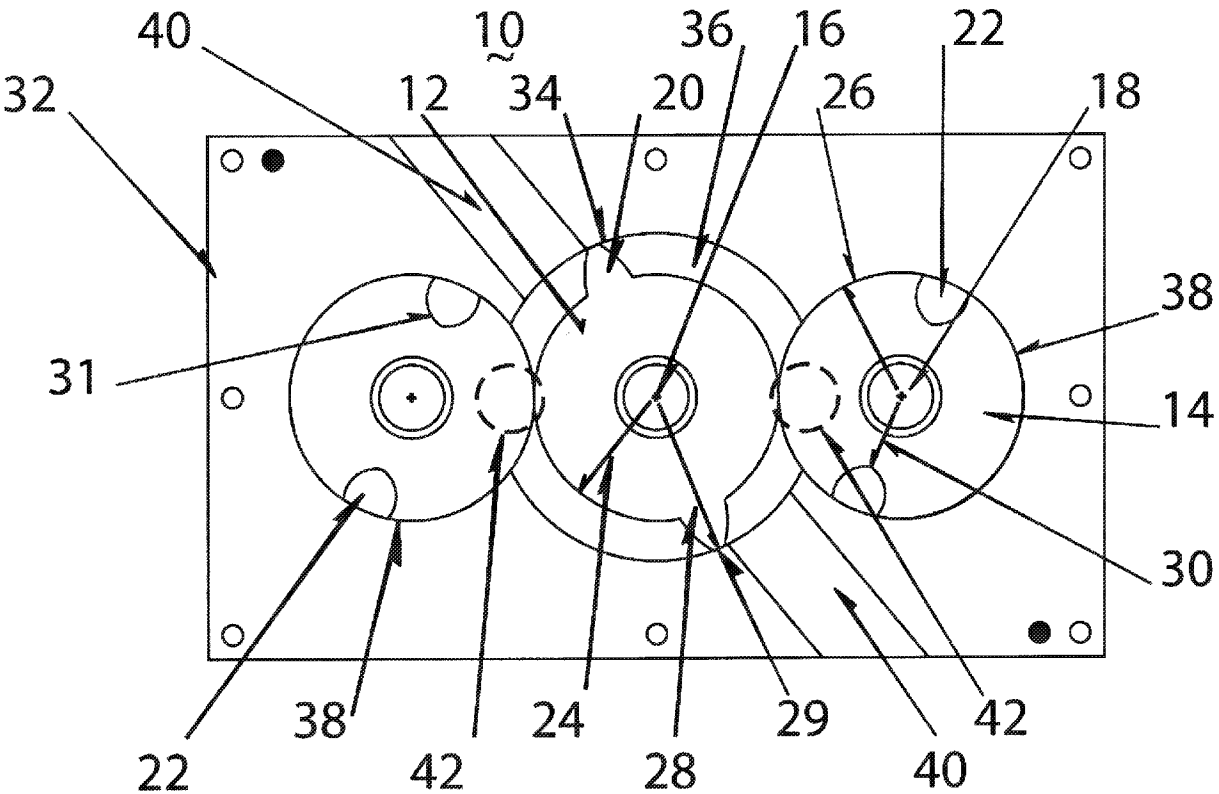
FIG. 1 shows a cross-section of a device according to the present invention.

As seen in cross-section in FIG. 1, the non-eccentric device 10 of the present invention includes at least a pair of rotors 12, 14 that each has an axis of rotation 16, 18 at the center of mass of the rotor. The first rotor 12 includes at least one extension 20, and is termed the extension rotor. The extension 20 is generally a mound-shaped protrusion on the edge of the rotor. The positioning of the extension(s) on the circumference of the rotor is selected so that the rotor is balanced to provide pure rotary motion. For example, with two extensions, the extensions are located 180° from each other, while with three extensions, the extension are located 120° from each other. With a single extension, the axis of rotation is preferably placed to achieve pure non-eccentric motion. Alternately, a counterbalance may be used to achieve non-eccentric motion. The extension rotor of the present invention is non-eccentric and thus more like the fan blade of a turbine engine then the piston of a piston engine or the rotor in the Wankel engine.

The second rotor 14 includes at least one chamber 22, and is termed the chamber rotor. The chamber 22 is generally an indentation into the edge of the rotor that is adapted to accept the extension. Like the extensions, the chambers are positioned on the circumference of the rotor is selected so that the rotor is balanced to provide pure rotary motion. Typically, the number of chambers will be equal to the number extensions, although this is not necessarily the case because the rotors may be sized so that a two-extension rotor could be used with a one-chamber rotor or so that a three-extension rotor could be used with a two-chamber rotor. Thus, the relative number of extensions and chambers is not critical so long as the rotors may be synchronously rotated and the extension(s) does not substantially interfere with the rotor rotation when the rotors are placed adjacent to each other.

The rotors each have a base radius 24, 26 that defines the size of the rotor. The distance between the respective axes of rotation 16, 18 is about the sum of the base radii. The extension rotor 12 has an extension radius 28 that defines the distance from the axis of rotation 16 to the extension apex 29. The length of the extension is the difference between the base radius 24 and the extension radius 28. Likewise, the chamber rotor 14 has a chamber radius 30 that defines the distance to the chamber nadir 31 from the axis of rotation 18. The depth of the chamber is the difference between the base radius 26 and the chamber radius 30. The extension length and chamber depth may be equal in the compressor and pump aspects. In the engine aspect, this is not necessarily so. While typically circular in shape, rotor shape is not so limited and may have any shape, including shapes that are not regular polygons.

The shape of the extension and the chamber are complementary to each other such that during rotation of the rotors, the extension sweeps through the chamber without catching on the chamber rotor or otherwise interfering with the rotation of the rotors. The extension may range in shape from an arc without discontinuities to a pair of arcs that meet at a discontinuity to a pair of arcs separated by an intermediate surface. Other shapes may also be suitable such as fins or vanes. An extension with a single discontinuity is preferred for the compressor aspect, while an extension with an intermediate surface is preferred for the engine aspect. The motion of the extension apex generally defines the shape of the chamber.

A gear assembly and/or shaft assembly (shown in FIGS. 3B-C) at each axis of rotation ensures the synchronous rotation of the extension rotor and the chamber rotor so that the extension moves unobstructed into and out of the chamber. The shaft assembly also provides a method of injecting or extracting power into or out of the system.

In addition, the present invention includes a rotor case 32 that houses the rotors and generally seals the rotors from ambient conditions. The rotor case typically includes several pieces to ease construction and assembly of the present invention, although this is not necessarily the case. The rotor case includes at least one interior cut-out in which the rotors reside. The cut-out defines one lobe for each rotor and is sized according to the particular rotor located in that lobe. For example, as seen in FIG. 1, the lobe 34 for the extension rotor must be able to accommodate the extension radius of the rotor. In this arrangement, a pressure cavity 36 is created between the extension rotor, the chamber rotor, and the rotor case (not including the roof and floor of the rotor case). The volume of the pressure cavity depends, inter alia, on the thickness of the rotor and the extension length. The lobe 38 associated with the chamber rotor need only accommodate the base radius of the chamber rotor.

The rotor case may include one or more intake and/or exhaust ports 40, 42, to facilitate operation of the system. The ports preferably have a flow path that is perpendicular or parallel to the axis of rotation of the rotors, although this is not necessarily the case.

The components of the present invention may be made out of any suitable material including metals, plastics, ceramics, composites, and combinations thereof. Preferred materials are light weight, yet have the strength to withstand the operating conditions, i.e., pressure and temperature, of the present invention. Preferred materials are not brittle. Preferred metals include aluminum and/or steel, although other alloys are also suitable. Suitable plastics include those known to be useful in components of piston or turbine engines. Although typically made of a unitary construction, the components may have any suitable construction such as multiple layers bonded together or shells over a ballast. Indeed, for metal components any suitable construction method may be used including molding, with machining being preferred. Likewise plastic components may be made by any suitable method including injection molding and machining A ceramic implementation may be particularly suitable as it would help eliminate changes in the sizes of the components due to temperature changes e.g. thermal expansion. Ceramic refers to any material that has strength at high temperatures and a low coefficient of thermal expansion. For example, silicon nitride has a coefficient of thermal expansion (CTE) of about $2\times10^{-6}$ in./in/F.°, while silicon carbide has a CTE of about $6\times10^{-6}$ in./in./° F. in the range of 2200 to 2875° F. Boron carbide has a lower coefficient of thermal expansion of about $4\times10^{-6}$ in./in./° F. The use of strong, low coefficient of expansion ceramic materials eliminates the need for contact seals at high temperatures. In addition, low coefficient of expansion ceramic materials can be implemented to prevent any possibility of mechanical interference at high temperature. A ceramic non-eccentric device would not require metal bearings. In one implementation, the ceramic non-eccentric device could use a vapor deposition of aluminum oxide on the shafts and on the case openings for the shafts. These special surfaces would be the bearings. Combustion pressures and temperatures in the non-eccentric engine can be controlled to eliminate undue stresses on the ceramic components.

One embodiment of the compressor aspect of the present invention is shown in cross-section in FIG. 2A-F. The compressor 100 includes one extension rotor 102 and two chamber rotors 104, 106. In this particular embodiment, the extension rotor 102 has two extensions 108, 110, while the chamber rotors 104, 106 each have two chambers 112, 114. The rotor case 116 includes two intake ports 118 and two exhaust ports 120. A pressure cavity 122 exists between the rotor case 116, the base radius of the extension rotor 102 and the base radius of the chamber rotor 104 or 106. Arrows 124, 126 show the direction of rotation of the rotors. A power input shaft is connected to the extension rotor to drive the rotor, while a gear assembly on the shaft ensures that the chamber rotors are also driven and that the rotors have synchronous rotation.

Figure 2A:
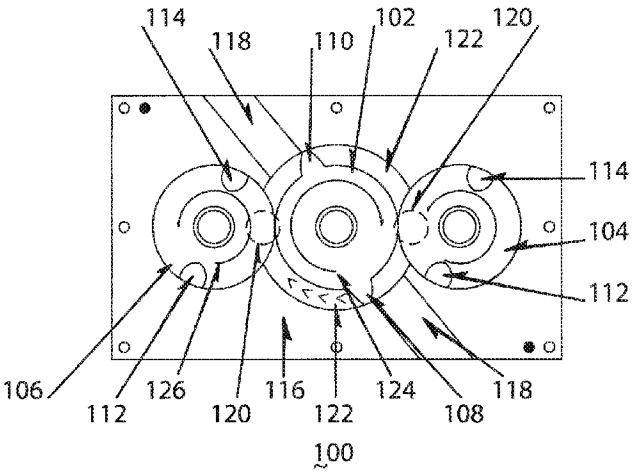
FIGS. 2A-2F show cross-sections of a compressor according to the present invention, including illustrating several different stages in the operation of the compressor.
Figure 2B:
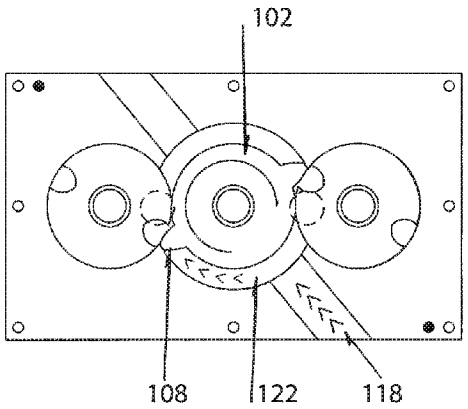
Figure 2C:
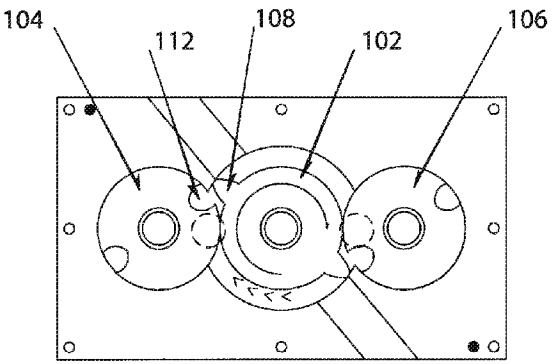
Figure 2D:
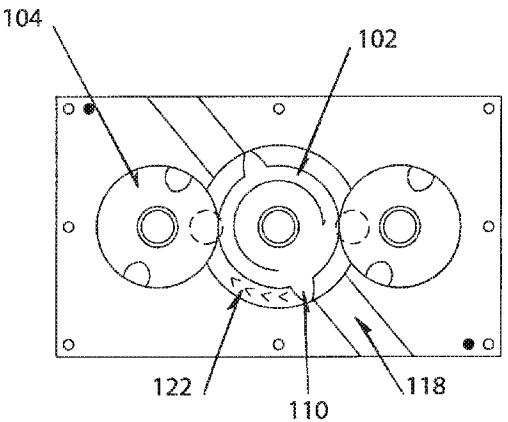
Figure 2F:
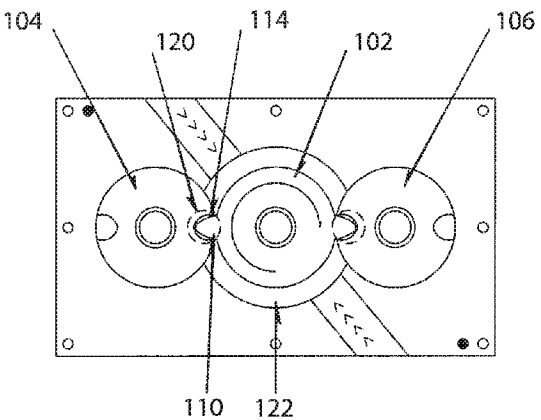
Figure 2E:
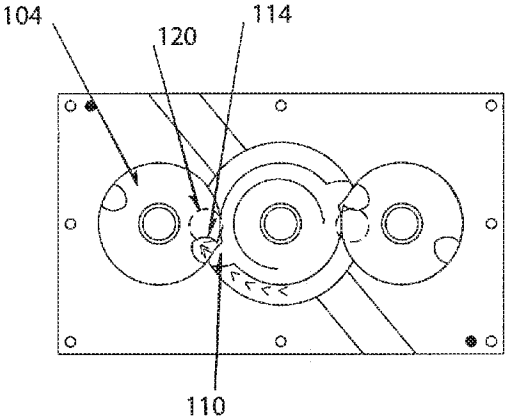

The compressor of the present embodiment may be divided into two halves where both have identical operation. Each half includes one chamber rotor, one intake port and one exhaust port, while the extension rotor is shared between the halves. Consequently, only the operation of one half of the compressor needs to be discussed in detail. As seen in FIG. 2B, as the shaft turns the extension rotor 102, the first extension 108 sweeps out a volume in the pressure cavity 122, creating a vacuum on the backside of the first extension 108. A gas (shown as chevrons) is drawn into this vacuum through the intake port 118. Due to the synchronous rotation of the extension rotor 102 and the chamber rotors 104, 106, the first extension 108 will be accepted in and sweep through the first chamber 112 (FIG. 2C). After this, the second extension 110 will close the intake port 118 (FIG. 2D) and start the compression of the gas that was drawn up in the pressure cavity by the vacuum created on the sweep of the first extension. Because of a seal between the chamber rotor 104 and extension rotor 102, the gas will not be able to escape and will thus be compressed on the front side of the second extension 110 as it sweeps out a volume in the pressure cavity 122. Just before the second extension 110 enters the second chamber 114, the gas is compressed down to a small pressure cavity that is made up of only the extension rotor 102 and the chamber rotor 104. The gas is enclosed by the walls of the chamber and the extension (as shown in FIG. 2E). As the second extension 110 sweeps through the second chamber 114, the exhaust port 120 is opened by the movement of the chamber rotor 104. Effectively, the chamber rotor 104, acts as a rotary valve to open and close the exhaust port. With the exhaust port 120 open, the compressed gas is forced out of the compressor, as can be seen in FIG. 2F, where the extension rotor 102 is top-dead center (TDC). This series of events is repeated for each half rotation of the extension rotor 102. As can be seen, the gas in the pressure cavity 122 is compressed to roughly the volume of the chamber 112 or 114. Since the chamber is significantly smaller than the cavity, the present invention can achieve significant rates of compression. Because the rotors have pure rotary motion, they may be run at high rpms without damaging the compressor or its components, thus achieving high compression rates.

To achieve maximal compression, the rotors, extensions, chambers and rotor case are sized and shaped so that seals are created wherever moving components contact or where a moving component contacts a stationary component. For example, the extension sealingly slides along the rotor case and the chamber wall during rotation of the rotors, while the extension rotor seals against the chamber rotor. Alternately, the rotors and rotor case need not be in contact with each other to provide for adequate sealing. Furthermore, the rotor case may include components that help seal the rotors from the ambient conditions.

A variety of valves and reservoirs may be used to increase the efficiency of the compressor. For example, a one-way valve located beyond the exhaust port may help prevent backflow. Furthermore, reservoirs may be used to as source of gas to be compressed or as storage for compressed gas.

In addition to gases, this device may operate on other fluids. For example, this device may pump liquids or gas/liquid mixtures. The location of the intake port may be adjusted to minimize the compression of the liquid while maximizing the volume of liquid being pumped. For example, the intake port may be moved closer to the exhaust port in the rotor case.

In an alternate mode of operation, the compressor device may be operated as an expander to efficiently produce heat, electricity and mechanical energy. Introducing high pressure gas into the chamber will push on the extension, thus driving the extension rotor to rotate. This produces mechanical energy which can be used through a gear linkage to accomplish work or be converted heat. The use of the Rankin cycle provides another operational mode for the present invention. In essence, the operation of the compressor described above with respect to FIGS. 2A-F is run in reverse. In this alternate mode of operation, port 120 is an intake port and port 118 is an exhaust port. A high pressure reservoir may be used to introduce gases under pressure at the now intake port 120 into a pressure cavity that is made up of the chamber rotor 104 or 106 and the extension rotor 102. The high pressure gases push on the extensions 108, 110 causing the extension rotor 102 to rotate, which can be used to generate electricity or tapped as a source of mechanical energy. As the extension rotor 102 rotates, the pressure cavity increases in volume (it is now formed by the extension rotor, chamber rotor and the rotor case) causing the high pressure gases to expand and give off heat. Depending on the type of gas, the gas may also condense to a liquid. In any event, continued rotation of the extension rotor 102 opens the now exhaust port 118, allowing the gases/liquids to exit to a collection reservoir. The collection reservoir may be fluidly connected to the high pressure reservoir to recycle the collected gases/liquids. The radiated heat may be used to heat the high pressure reservoir, the collection reservoir, some other reservoir, or some other space. In one embodiment of this alternate mode of operation, the high pressure gas utilized is water vapor that is preferably created through the use of solar energy. The solar energy is thus efficiently turned into heat, electricity and/or mechanical energy.

In another embodiment of the pump aspect of the present invention, the non-eccentric device operates as a vacuum pump. In this embodiment, two chamber rotors, one extension rotor and a rotor case are used with a synchronizing gear or mechanism. Each chamber rotor has three chambers, and the extension rotor has three extensions. In operation as a vacuum pump, as the first extension leaves the chamber, it passes by an intake port. The continuous movement of the first extension forms a vacuum between the chamber rotor, the extension rotor, and the case. This draws gases in through the intake port. The extension moves within the case approximately 120 degrees where there is an exhaust port. The gases drawn in behind the first extension are trapped by a second extension as the second extension leaves a chamber. The front side of the second extension forces the previously drawn in gases out of the exhaust port. The first extension moves through the chamber of the second chamber rotor and past a second intake port and the process is repeated.

Carbon or other types of seals maybe used to improve vacuum draw down. The seals ride in the apex of the extensions, the sides of the extension, and between the case and the extension and chamber discs (these are circular and ride on the disc faces).

Figure 3A:
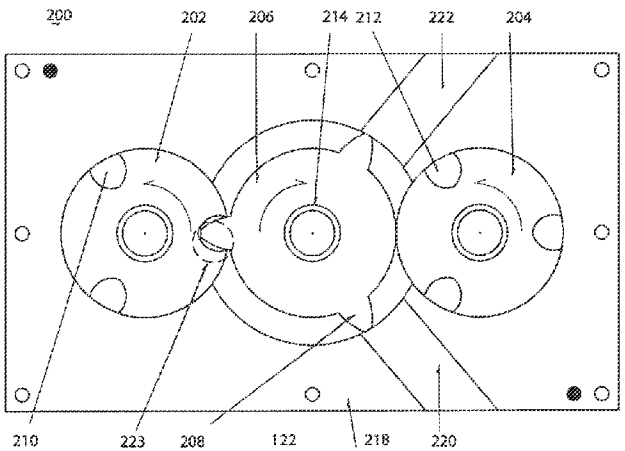
FIGS. 3A-3C show cross-sectional and isometric views of an engine according to the present invention.
Figure 3B:
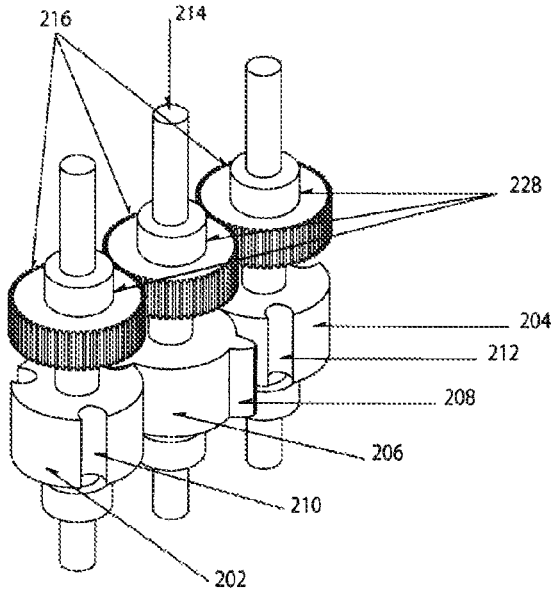
Figure 3C:
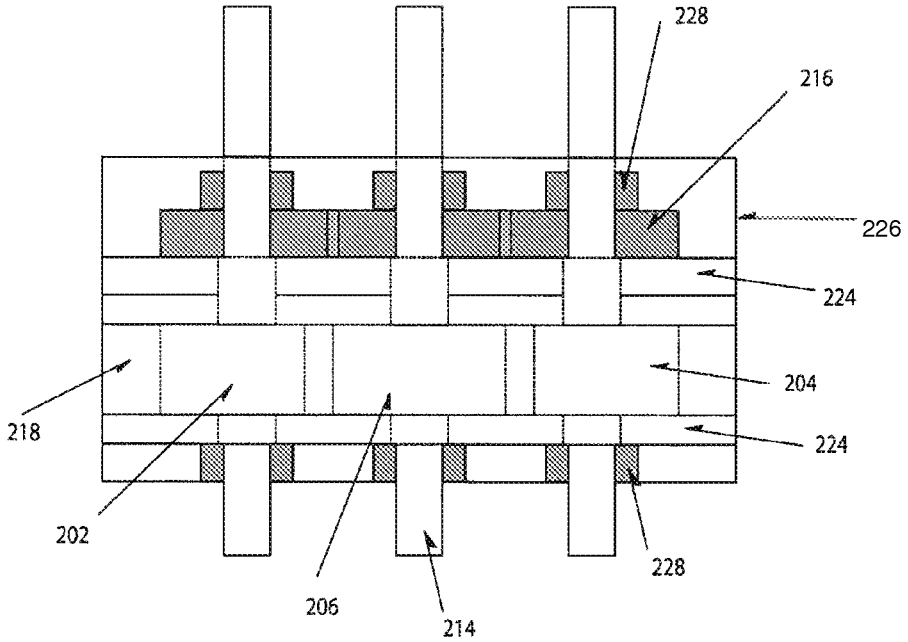

One embodiment of the engine aspect of the present invention is shown in FIGS. 3A-C. In this embodiment, the engine 200 includes three rotors: two chamber rotors and one extension rotor. The first chamber rotor is called the combustion rotor 202, while the second chamber rotor is called the isolation rotor 204. The extension rotor is called the power rotor 206. In this particular embodiment, the power rotor 206 has three extensions 208, which correspond to the three chambers 210 of the combustion rotor 202 or the three chambers 212 of the isolation rotor 204. A power output shaft 214 is connected to the power rotor 206. A gear assembly 216, as seen in FIGS. 3B-C, synchronizes the rotation of the three rotors. A rotor case 218 also includes an intake port 220 and an exhaust port 222. An ignition source 223 is located near the combustion rotor 202. As best seen in FIG. 3C, the rotor case 218 may include a variety of plates 224, gearboxes 226, and bearings 228 to facilitate operation of the engine. In addition, a variety of seals may be located on the plates to help seal the rotors from the ambient conditions or to seal in fluids or gases. For example, a seal may be used against the face of the rotor to reduce the likelihood of leakage between the rotor face and the rotor case. This type of seal is essentially just a sheet of material that abuts the rotor face. The seal may reduce the machining tolerances required for the non-eccentric device. The seal may be made of a resilient or slightly resilient material to improve the seal between the rotor and the material. Alternately, one or more springs or other resilient device may be used to increase the pressure of the seal on the rotor.

Placement of the ignition source (e.g. spark plug, glow plug, or the like) depends on the type of fuel to be utilized. For example, when using gasoline or other slow burning fuels, the spark plug may be placed between about 20 degrees before TDC and about 20 degrees after TDC (i.e. when the extension is fully within the chamber). For faster burning fuels, such as diesel, alcohols or in detonation combustion situations, the glow or spark plug may be placed between about 10 degrees and 2 degrees before TDC and more preferably between about 6 degrees and about 4 degrees before TDC.

In the engine, like the compressor, it is preferable that the rotors are sized and shaped so that seals are created wherever the rotors are close to each other, as discussed below. Furthermore, the extension sealingly slides along the rotor case during rotation of the rotors. Alternately, the rotors and rotor case need not be in contact with each other to provide for adequate sealing for operation. Moreover, seals, as discussed above, may also be utilized, but are not preferred.

Figure 8:
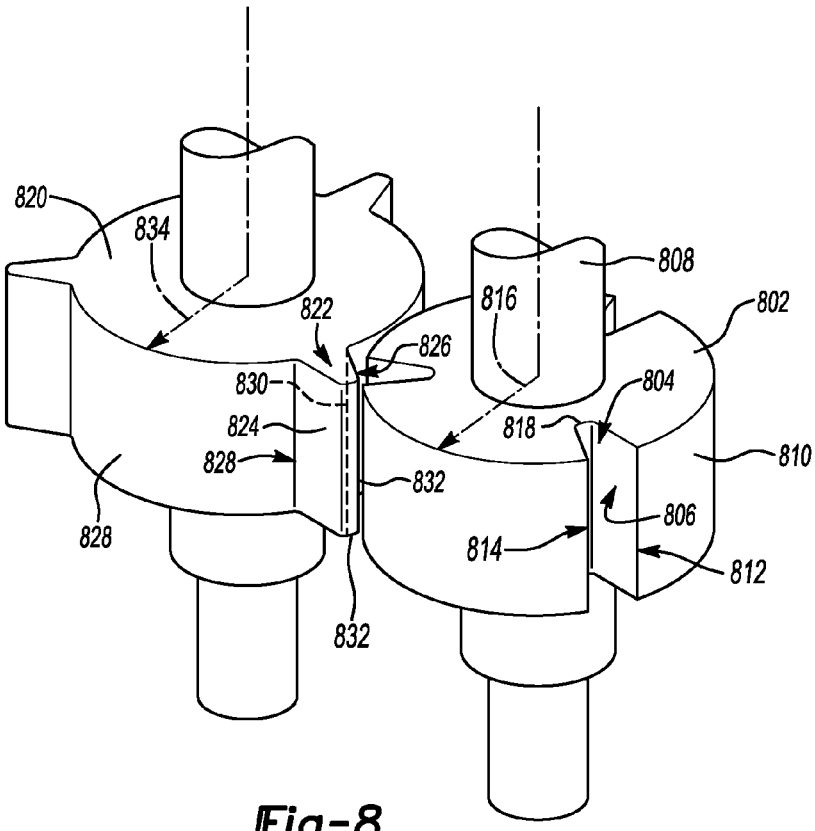
FIG. 8 shows an enlargement of a chamber rotor and an extension rotor.

A close up of the extension and chamber rotors is shown in FIG. 8. The chamber rotor 802 has a chamber 804 with a chamber wall 806 that is roughly vertical and parallel to the shaft 808 on the rotor. The chamber rotor wall 810 makes up the circumference of the chamber rotor 802. The chamber corners 812, 814 are the locations where the chamber wall meets the chamber rotor wall. The chamber rotor radius 816 is the distance from the center of the chamber rotor to the chamber rotor wall. The chamber nadir 818 is the point where the chamber is the deepest (i.e. where the chamber is closest to the chamber rotor shaft). Conversely, the extension rotor 820 has an extension 822 with a first wall extension wall 824 and a second extension wall 826 on the other side of the extension 822. The extension rotor wall 828 makes up the circumference of the extension rotor 820. The extension corners 828, 830 (shown with dotted line) are the locations where the extension walls meet the extension rotor wall. The extension apex 832 is the point where the extension is the tallest (i.e. where the extension is furthest from the extension rotor shaft). The extension apex is also the location where the two extension walls meet. The extension rotor radius 834 is the distance from the center of the extension rotor to the extension rotor wall 828.

The engine of the present invention is designed to achieve a desired compression ratio. While any desired compression ratio may be used, preferably the compression ratio is in the range of about 20:1 to about 30:1. While the exact compression ratio is not critical, as will be seen an iterative process may be used to obtain an engine with the desired compression ratio. The compression ratio is the displacement of the extension divided by the volume of the chamber when the extension is TDC. The displacement of the extension is extension height multiplied by the rotor thickness multiplied by the sweep of the extension. The sweep of the extension is a portion of the circle swept by the extension during compression and is typically one divided by the number of extensions on the extension rotor, e.g. ⅓ for an extension rotor with three extensions.

Having selected the desired compression ratio and calculated the displacement by selecting the extension height, the volume of the chamber when the extension is TDC can also be calculated. With these general parameters in hand, the shape of the extension and chamber can be determined.

Several design considerations go into determining the shape of the extension and the chamber. First, the extension and chamber rotors must not collide with each other during rotation. Collisions may cause damage to the rotors, thus creating burrs or other debris in the engine or otherwise compromising the sealing of the rotors against one another. Particular areas of concern are the chamber corners, the chamber nadir, the extension corners and the extension apex.

Second, the extension and chamber rotors need to maintain compression during rotation. Maintaining compression means that the rotors seal against one another by preventing the majority of the combustion gases from escaping. Preferably, "seal against one another" means that there is less than about $1/1000^{th}$ of an inch between the extension and the chamber, between the chamber rotor and rotor case, or between the extension and the rotor case. More preferably, "seal against one another" means that there is less than about $5/10{,}000^{th}$ of an inch between the extension and the chamber, between the chamber rotor and rotor case, or between the extension and the rotor case. Most preferably, "seal against one another" means that this is less than about $2/10{,}000^{th}$ of an inch between the extension and the chamber, between the chamber rotor and rotor case, or between the extension and the rotor case. Given the amount of pressure present in a combustion engine, it is very difficult to seal at a point or line. Rather it would be preferably to have the extension wall and the chamber wall seal at an area. For example, when the extension wall and the chamber wall come the closest to touching (e.g. less than about $1/1000^{th}$ of an inch), an area of the extension wall seals against an area of the chamber wall. The over arching consideration is that the rotors, chambers and extensions need to be close enough to each other to seal but not too close that they collide with a level of precision that less than about $1/1000^{th}$ of an inch. This level of precision is preferably found in engines, compressors and pumps according to the present invention.

The third consideration is that, unlike the compressor, the engine requires a slightly different gas flow pattern. In order to provide power to the extension rotor, the combustion gasses need to push on the extension. To accomplish this, the combustion gasses need to be able to travel to back side of the extension. In one embodiment, the combustion gases travel around the end of the extension when the extension is in the chamber, e.g. when the extension is TDC (or close thereto) of the chamber. To facilitate this gas flow pattern, the extensions may be sized and shaped so that there is a gap between the extension wall and the chamber wall when the extension is TDC or slightly before or after TDC (e.g. ±5°). This may be accomplished by providing a slightly shortened extension or by providing a plateau extension where the extension apex has been loped off or otherwise flattened. Alternately, this may be accomplished by a providing a chamber with a slightly deeper nadir or by providing a chamber wall where the shape has been adjusted to assure that the extension apex does not seal against the chamber wall when then extension rotor is about ±20° from TDC. The requirement of the shortened extension at about TDC combined with the sealing at other points during the rotation create a set of competing design criteria that have not been previously been satisfied.

All of these considerations show that the size and shape of the extension and of the chamber are dependent on each other. Either may be designed first, but it is preferred to design the extension first and then design the chamber second because as discussed above the extension height is selected in conjunction with the compression ratio of the engine. The method of designing the extension including calculating a series of coordinates (e.g. Cartesian or polar) that form curves that delineates the extension walls. The shape of the chamber is then calculated using some or all of the coordinates from the calculation of the extension shape. The calculated coordinates (or curves) may be fed to a computer control machining device (e.g. a milling machine) to remove material (e.g. metal or ceramic) from a rotor blank to create the extension rotor or the chamber rotor. As discussed below, the calculated coordinates may be modified to help achieve one or more of the considerations discussed above (e.g. to help achieve sealing or prevent collisions).

Figure 9A:
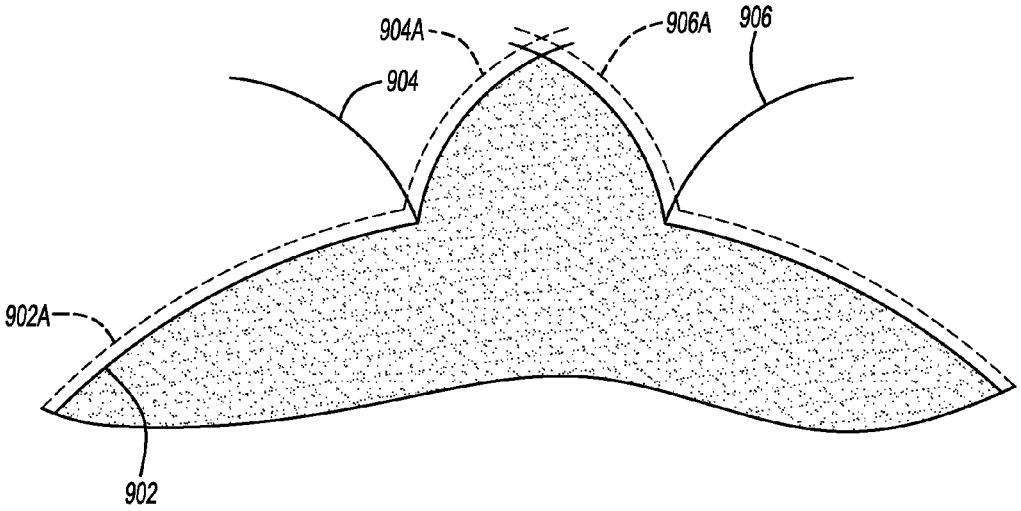
FIGS. 9A and 9B shows graphs of calculations used to determine the shape of the extension and the chamber.
Figure 9B:
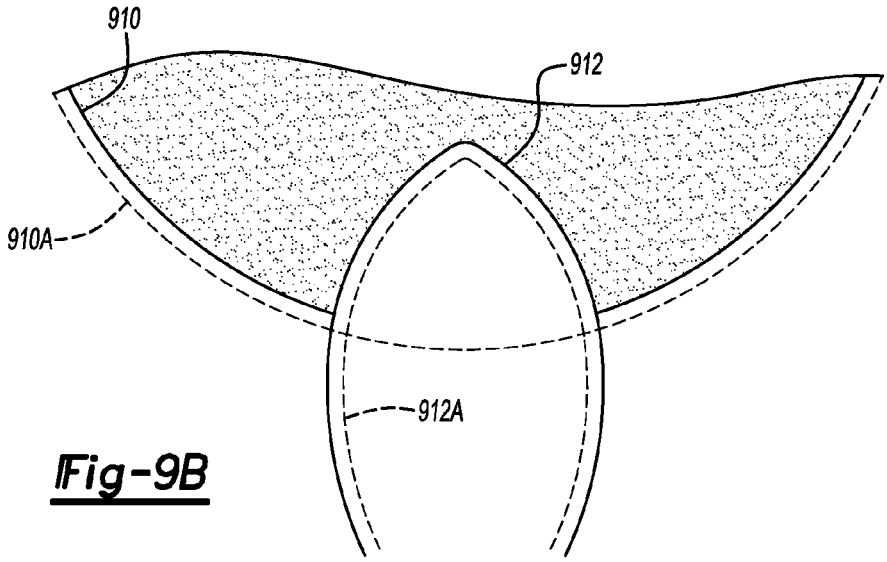

FIG. 9A shows a graph of the calculated coordinates that delineate the extension walls and FIG. 9B shows a graph of the calculated coordinates that delineate the chamber wall. These are essentially top views of the extension and chamber rotors. As discussed in more detail below, Line 902 represents the extension rotor wall. Line 904 represents the left side of the extension wall, while the right side of the extension wall is shown by Line 906. Dotted Lines 902A, 904A and 906A represent the center of the tool path that is used to shape the extension rotor (e.g. with a milling tool) from a blank. Bracket 908 shows the extension width. In FIG. 9B, Line 910 represents the chamber rotor wall. Line 912 represents the chamber wall. Dotted Lines 910A and 912A represent the center of the tool path that is used to shape the chamber rotor from a blank (e.g. a milling tool). The axes are arbitrarily placed to show the location of the extension apex and the chamber nadir, respectively. The shading shows the material remaining after shaping.

To calculate coordinates that delineate the extension walls, several starting parameters are needed. Besides the extension rotor radius and the chamber rotor radius, a parameter, Theta_1, is used. The extension height selected during the compression ratio calculation determines Theta_1; Theta_1, when doubled, expresses, in radians, the width of the extension along the circumference of the extension rotor.

In the alternative, the value of Theta_1 may also be used to determine the extension height of the extension apex. Any value of Theta_1 may be used as a starting value. The curve that delineates the extension wall is calculated in two steps; first one curve is calculated, and second the other curve is calculated corresponding to either side of the extension. For convenience, the curves are arbitrarily called the left side and the right side of the extension. Compared to a starting value of Theta_1, using a larger Theta_1 will result in an extension that is wider and taller. Conversely, using a smaller Theta_1 will result in an extension that is narrower on the rotor and shorter. Thus, the extension height can be modified by iteratively adjusting the starting value of Theta_1 in order to obtain the desired extension height. Since the extension height determines the compression ratio of the engine, Theta_1 is proportional to the compression ratio of the engine. Reducing Theta_1 will reduce the compression ratio. Conversely, increasing Theta_1 will increase the compression ratio.

To calculate the left side curve of the extension, the following equations are used:

$$X=[A+C]\ \mathrm{Cos}(\mathrm{Theta}-\mathrm{Theta_1})-[C]\ \mathrm{Cos}(([A+C]/[C])\mathrm{Theta}),\ \text{and}$$

$$Y=[A+C]\ \mathrm{Sin}(\mathrm{Theta}-\mathrm{Theta_1})-[C]\ \mathrm{Sin}(([A+C]/[C])\mathrm{Theta}),$$

where A=chamber rotor radius, C=extension rotor radius and Theta is a value in radians.

Using a starting value of Theta=0, the calculation is carried out by incrementing Theta (e.g. 0.001 rad, 0.01, rad, 0.1 rad, 0.25 rad, 0.5 rad, etc.) in a positive manner until X^2+Y^2=(A+B)^2, where B is the extension height as selected in the compression ratio calculation. At this point the extension height and the chamber depth are the same because the chamber cannot be smaller than the extension. Positive incrementing of Theta will give the curve for the left side of the extension wall; Line 904 in FIG. 9A.

The calculation of the right side curve of the extension uses the following equations:

$$X=[A+C]\ \mathrm{Cos}(\mathrm{Theta}+\mathrm{Theta_1})-[C]\ \mathrm{Cos}(([A+C]/[C])\mathrm{Theta}),\ \text{and}$$

$$Y=[A+C]\ \mathrm{Sin}(\mathrm{Theta}+\mathrm{Theta_1})-[C]\ \mathrm{Sin}(([A+C]/[C])\mathrm{Theta}),$$

where A=chamber rotor radius, C=extension rotor radius and Theta is a value in radians.

Again starting with Theta=0, this time Theta is incremented in a negative manner until X^2+Y^2=(A+B)^2. Negative incrementing of Theta will give the curve for the right side of the extension wall; Line 906 in FIG. 9A.

Where the left side and the right curves meet is the extension apex.

In an alternate method, the compression ratio may also be manipulated by reducing the height of the extension, while maintaining the extension width the same and maintaining the chamber nadir the same. In another alternate method, by reducing the height of the extension while maintaining its width, the depth of the chamber nadir may be decreased, thus leading to an increase in the compression ratio of the engine.

As discussed above, the depth of the chamber is dependent on the height of the extension, as the chamber depth cannot be less than the extension height. There would be collision otherwise. The extension height is used in the calculation of the curve for the chamber wall as discussed below.

To calculate the coordinates that delineate the chamber wall, several starting parameters are needed, namely the chamber rotor radius and the chamber depth/extension height calculated above. To reiterate, the chamber depth is equal to or greater than the extension height calculated above, thus guaranteeing that the extension (before apex removal) will fit within the chamber when the extension is TDC. The curve of the chamber wall is calculated using the following equations:

$$X=[A+C]\ \mathrm{Cos}(\mathrm{Theta})-[C+B]\ \mathrm{Cos}(([A+C]/[C])\mathrm{Theta}),$$

and $$Y=[A+C]\ \mathrm{Sin}(\mathrm{Theta})-[C+B]\ \mathrm{Sin}(([A+C]/[C])\mathrm{Theta}),$$

where A=chamber rotor radius, B=chamber depth, C=extension rotor radius, and Theta is a value in radians.

Similar to above the starting value of Theta is 0 and Theta is incremented in a positive and a negative manner until $X^2+Y^2=(A-B)^2$. Positive and negative incrementing of Theta will give a smooth curve for chamber wall; Line 912 in FIG. 9B.

Through this set of calculations, several of the design considerations discussed above are met. Namely, the extension rotor and the chamber rotor will not collide during rotation, while maintaining the compression built during rotation. Further, the curves of the extension wall and the chamber wall calculated as above result in sealing between the extension and the chamber.

Figure 10A:
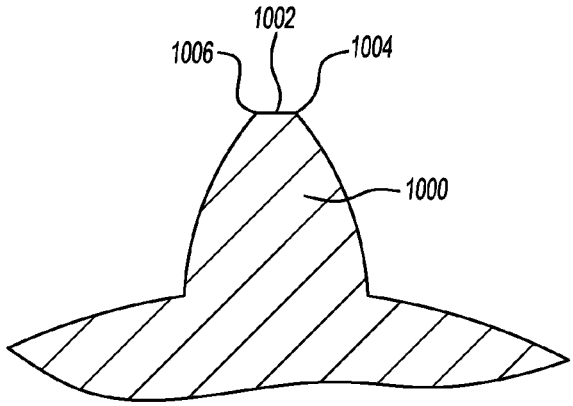
FIGS. 10A and 10B show close ups of the extension and the chamber.

In a preferred embodiment, the extension apex is removed to create a plateau, thus shortening the height of the extension. The amount of the extension that is removed is selected to insure adequate movement of the combustion gases from the front side of the extension to the back side of the extension. The amount of the extension removed may be expressed in a percentage of the of the extension height. For example, about 0.1%, about 0.5%, about 1.0%, about 5.0%, about 10%, about 20% of the extension height may be removed to create the plateau. An extension 20 with a plateau is shown in FIG. 1 and in close up in FIG. 10A at 1000 with plateau 1002. As a consequence of apex removal, two plateau corners 1004, 1006 are created, as shown in FIG. 10A, where there used to be only one corner i.e. the extension apex. Extension apex removal is completed after the curves for the extension walls and the chamber wall have been completed.

Figure 10B:
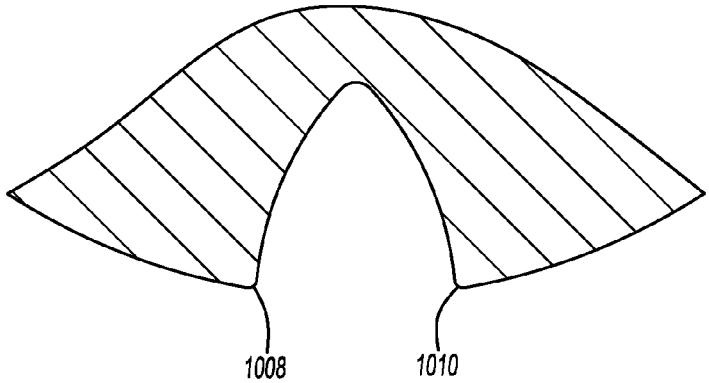

To further insure that sealing occurs and collisions do not occur, various corners may be rounded off with a radius to remove sharp changes in direction. For example, as seen in FIG. 10B, the chamber corners 1008, 1010 may be rounded off. Likewise, the extension corners and the plateau corners may be rounded off. In one embodiment, the round off of chamber and extension corners may be estimated and may be part of an oval or ellipse. In another embodiment, a radius is used to round off the corner, where the radius is tangential to both the chamber wall and the chamber rotor wall. In a preferred embodiment, the radius of the round off for the chamber corner is the radius of the milling tool used to shape the extension rotor from a blank. By matching the chamber corner radius to the milling tool radius used to shape the extension root, sealing between the extension and the chamber is achieved during rotation. Thus, preferably a level of precision of less than about $1/10{,}000^{th}$ of an inch is achieved. In this way, the extension seals to the chamber but does not collide with it.

Figure 12A:
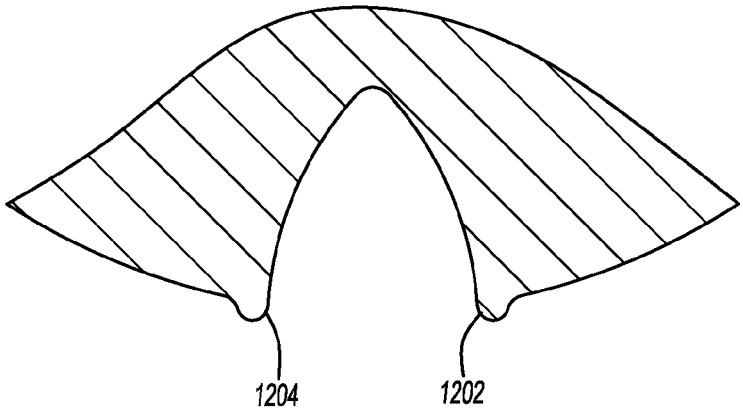
FIGS. 12A and 12B show close ups of the extension and the chamber including positive and negative interlocks.
Figure 12B:
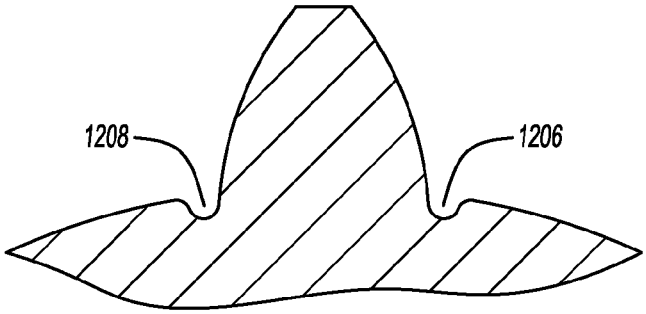

In another embodiment, an interlocking mechanism is utilized to improve the sealing between the chamber and the extension rotors during operation. The interlocking mechanism includes one or more teeth on one rotor in combination with a number of tooth spaces on the other rotor. Preferably, a single tooth on each side of the chamber on the chamber rotor mates with single tooth spaces on the extension rotor. FIG. 12A shows a portion of chamber rotor with interlocking teeth 1202, 1204 on either side of the chamber. FIG. 12B shows a portion of an extension rotor with interlocking tooth spaces 1206, 1208 on either side of the extension.

The interlocking tooth protrudes slightly from the chamber rotor such that its height is larger than the chamber rotor diameter, when measured from the center of the rotor. Likewise, the interlocking tooth space is slightly dipped from the extension rotor such that its nadir is deeper than the extension rotor diameter when measured from the center of the rotor. The teeth and the corresponding tooth spaces are sized and shaped so that, in operation, the two components provide effective sealing of the two rotors against one another. In one embodiment, the tooth spaces are slightly wider than the teeth; that is, the tooth space(s) extend along the extension rotor diameter and away from the extension. In this manner, the requisite sealing is achieved and the risk of collision between the extension rotor and chamber rotor is reduced. In another embodiment, the tooth spaces on the extension rotor slightly undercut the extension.

When a cutting apparatus with any effective diameter is used (e.g. a rotary milling tool), that diameter must taken into account when shaping the extension and chamber. If such diameters are not considered, the extension will be too small and the chamber too big. The calculation for the tool path is the same as the calculation of the coordinates that delineate the extension walls and chamber wall with an additional component for the radius of the cutting apparatus. Thus, the curve for the tool path for the left side of the extension is:

$$X=[A+C]\ \mathrm{Cos}(\mathrm{Theta}-\mathrm{Theta_1})-[C-D]\ \mathrm{Cos}(([A+C]/[C])\mathrm{Theta}),\ \text{and}$$

$$Y=[A+C]\ \mathrm{Sin}(\mathrm{Theta}-\mathrm{Theta_1})-[C-D]\ \mathrm{Sin}(([A+C]/[C])\mathrm{Theta}),$$

where A=chamber rotor radius, C=extension rotor radius, D=cutting apparatus radius and Theta is a value in radians. The curve for the tool path for the right side of the extension is:

$$X=[A+C]\ \mathrm{Cos}(\mathrm{Theta}+\mathrm{Theta_1})-[C-D]\ \mathrm{Cos}(([A+C]/[C])\mathrm{Theta}),\ \text{and}$$

$$Y=[A+C]\ \mathrm{Sin}(\mathrm{Theta}+\mathrm{Theta_1})-[C-D]\ \mathrm{Sin}(([A+C]/[C])\mathrm{Theta}),$$

where A=chamber rotor radius, C=extension rotor radius, D=cutting apparatus radius and Theta is a value in radians. The curve for the tool path for the chamber is:

$$X=[A+C]\ \mathrm{Cos}(\mathrm{Theta})-[C+B-D]\ \mathrm{Cos}(([A+C]/[C])\mathrm{Theta}),\ \text{and}$$

$$Y=[A+C]\ \mathrm{Sin}(\mathrm{Theta})-[C+B-D]\ \mathrm{Sin}(([A+C]/[C])\mathrm{Theta}),$$

where A=chamber rotor radius, B=chamber depth, C=extension rotor radius, D=cutting apparatus radius and Theta is a value in radians.

The calculations are carried out as above with regard to the calculations for the extension walls and chamber walls.

Figure 4A:
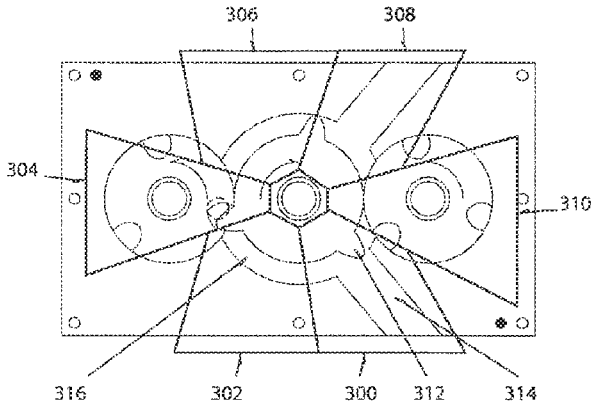
FIGS. 4A-C show a cross-section of an engine according to the present invention with operational zones demarcated.
Figure 4B:
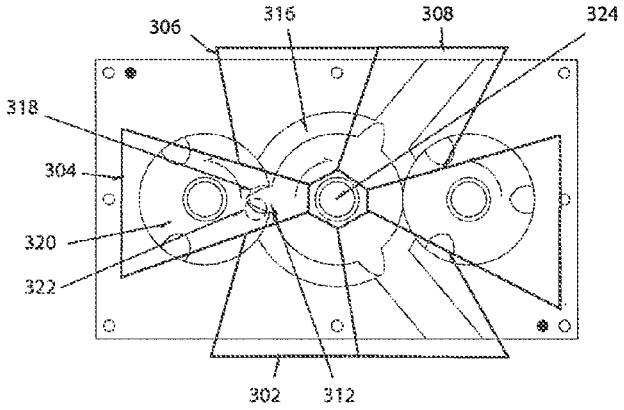
Figure 4C:
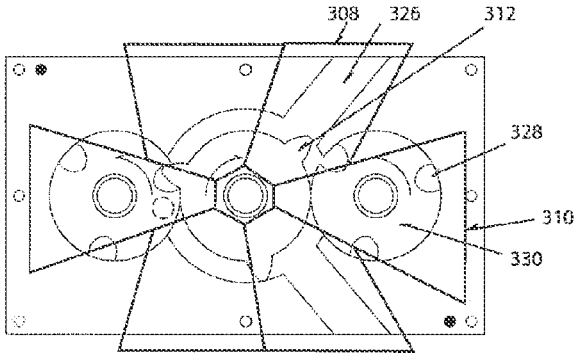

FIGS. 4A-C show a general overview of the operation of this embodiment of the engine aspect of this invention. Although no strict boundaries exist, the engine generally has six zones, which are: intake 300, compression 302, combustion 304, power 306, exhaust 308 and isolation 310. In the intake zone 300, the extensions 312 sweep through to alternately close then open the intake port 314 to the introduce intake gases, i.e., air/fuel mixture. In the compression zone 302, the extensions 312 sweep through the pressure cavity 316 to compress the intake gases. In the combustion zone 304, the extensions 312 cooperate with the chambers 318 of combustion rotor 320 to provide a pressure cavity with compressed intake gases that are ignited by a spark plug 322 to create the propelling combustion gases. In the power zone 306, the ignited combustion gases expand in the pressure cavity, pushing on the extension 312 and providing power to the power shaft 324 of the engine. In the exhaust zone 308, the extensions 312 sweep through to alternately open and close the exhaust port 326 and expel exhaust gases. In the isolation zone 310, the extensions 312 cooperate with the chambers 328 of the isolation rotor 330 to prevent exhaust gases from mixing with the intake gases.

Figure 5A:
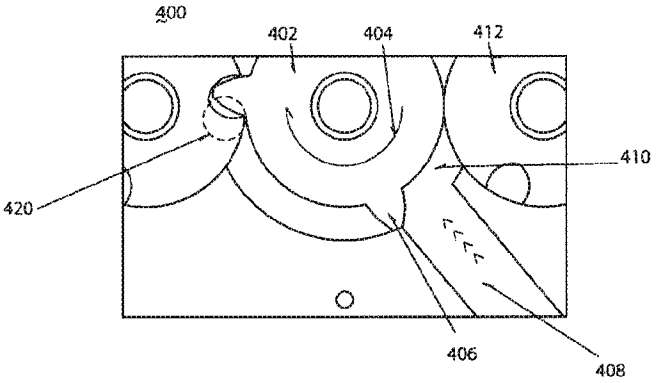
FIGS. 5A-G show cross-sections of an engine according to the present invention, including illustrating several different stages in the operation of the engine.
Figure 5B:
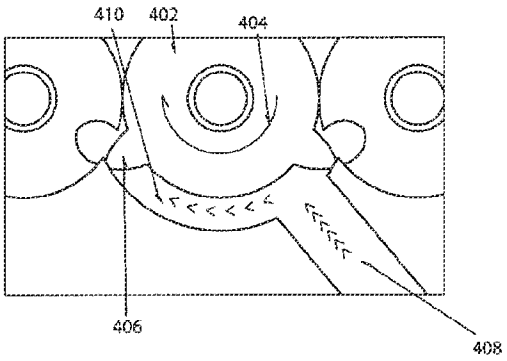
Figure 5C:
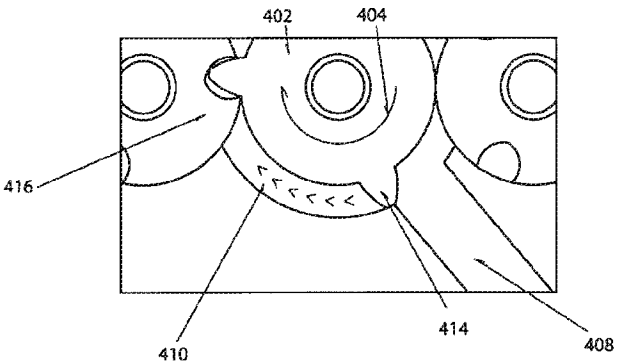
Figure 5D:
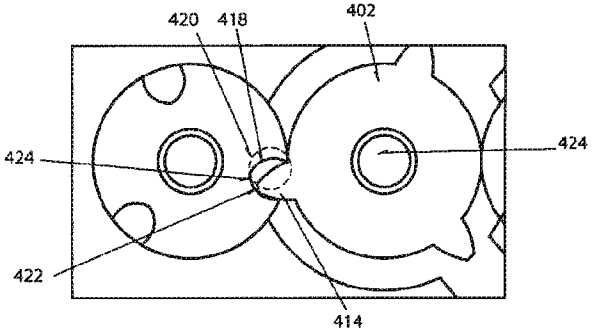
Figure 5F:
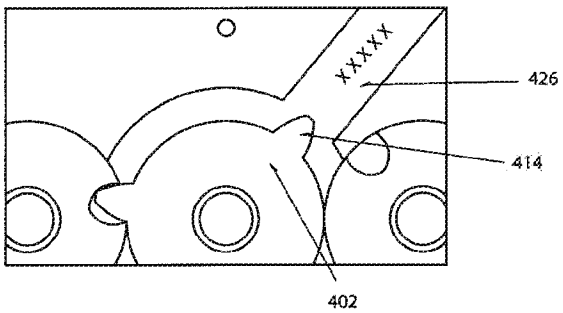
Figure 5E:
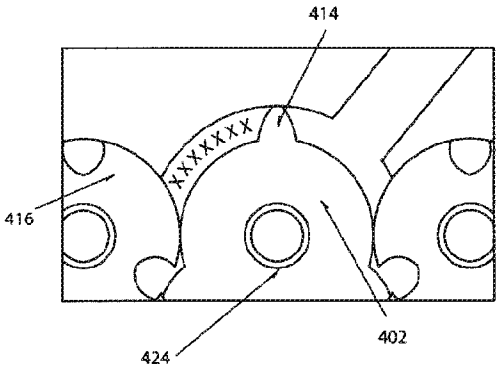
Figure 5G:
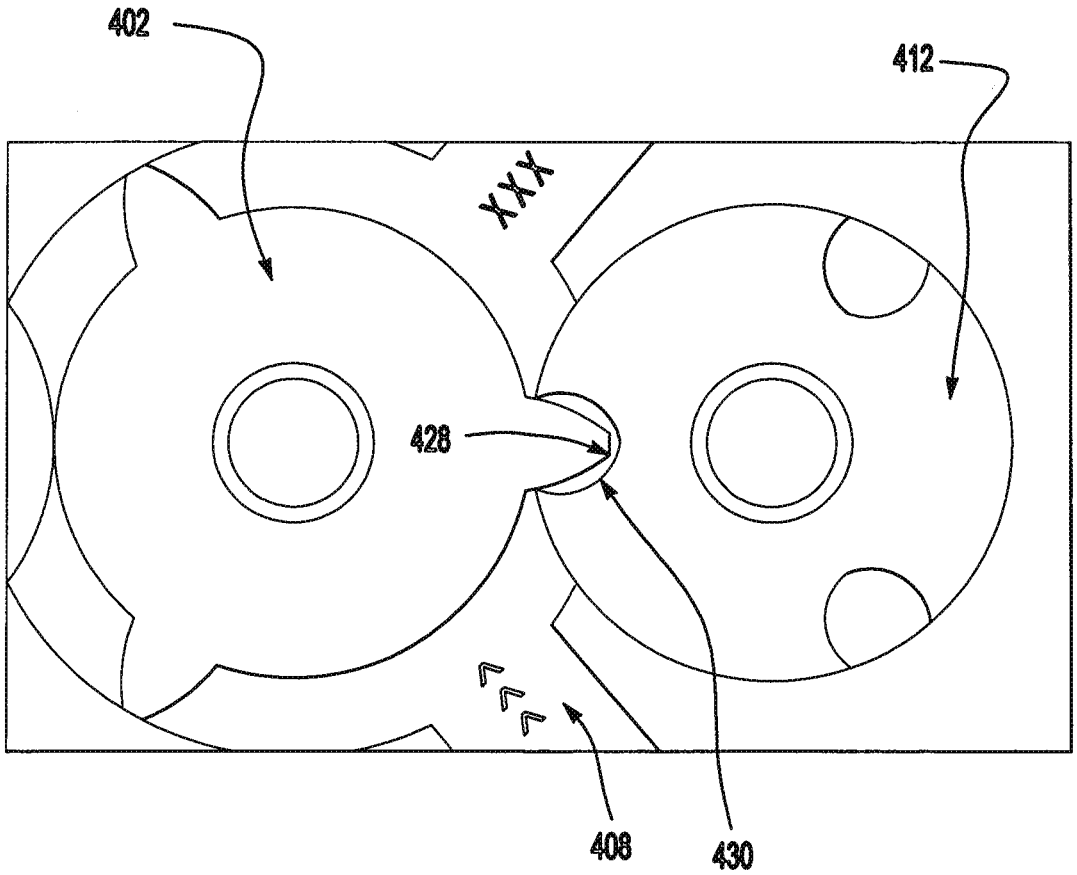

With reference to FIGS. 5A-G, a more detailed description of the operation of the engine is provided. As seen in FIG. 5A, in the engine 400, as the power rotor 402 rotates forward in the direction of the arrow 404, the first extension 406 opens the intake port 408 to allow the intake gases (shown as chevrons) into the cavity 410. The intake gases are prevented from back flowing by the seal between the power rotor 402 and the isolation rotor 412. As the first extension 406 continues to rotate forward, as seen in FIG. 5B, it creates a vacuum on its backside and draws the intake gases into the cavity 410 from intake port 408. As seen in FIG. 5C, further rotation of the power rotor 402 causes the second extension 414 to close the intake port 408 and seal the cavity 410. Continued rotation causes the second extension 414 to compress the intake gases in the cavity 410 against the combustion rotor 416 and the rotor case. The seal between the power rotor 402 and the combustion rotor 416 prevents the compressed intake gases from escaping. As seen in FIG. 5D, the intake gases move into the chamber 418 in front of the second extension 414 as it begins to sweep through the chamber 418. A spark plug 420 ignites the compressed intake gases just before the power rotor 402 reaches TDC. Because the extension apex 422 is slightly spaced from the chamber nadir 423, the extension apex 422 does not contact the chamber wall at the nadir. Consequently, the expanding combustion gases move from the front side of the second extension 414 to the backside, pushing on the backside of the second extension and transfer power to the power shaft 424. As seen in FIG. 5E, the combustion gases (shown as crosses) are prevented from back flowing by the seal between the power rotor 402 and the combustion rotor 416 and transfer power to the power shaft 424. As seen in FIG. 5F, continued rotation opens the exhaust port 426 and allows the combustion gases to vent without the need for valves or other mechanical devices. Indeed, the next extension effectively forces the majority of the exhaust gases out through the exhaust port 426 as it sweeps through. As seen in FIG. 5G, any remaining exhaust gases are effectively isolated from the intake zone. Similar to as discussed above with respect to the combustion zone, the extension apex 428 does not contact the valve rotor 428 and forces any remaining exhaust gases from front side of the extension 414 to the backside of the extension. As the extension 414 leaves the chamber 430, it seals the chamber from the intake zone, such that any remaining exhaust gases are trapped in the chamber. This completes one rotation of the extension rotor and is roughly equivalent to two piston strokes of a four stroke engine and a one piston stroke of a two-cycle engine. The process starts again with the intake of gases at intake port 408.

Figure 6:
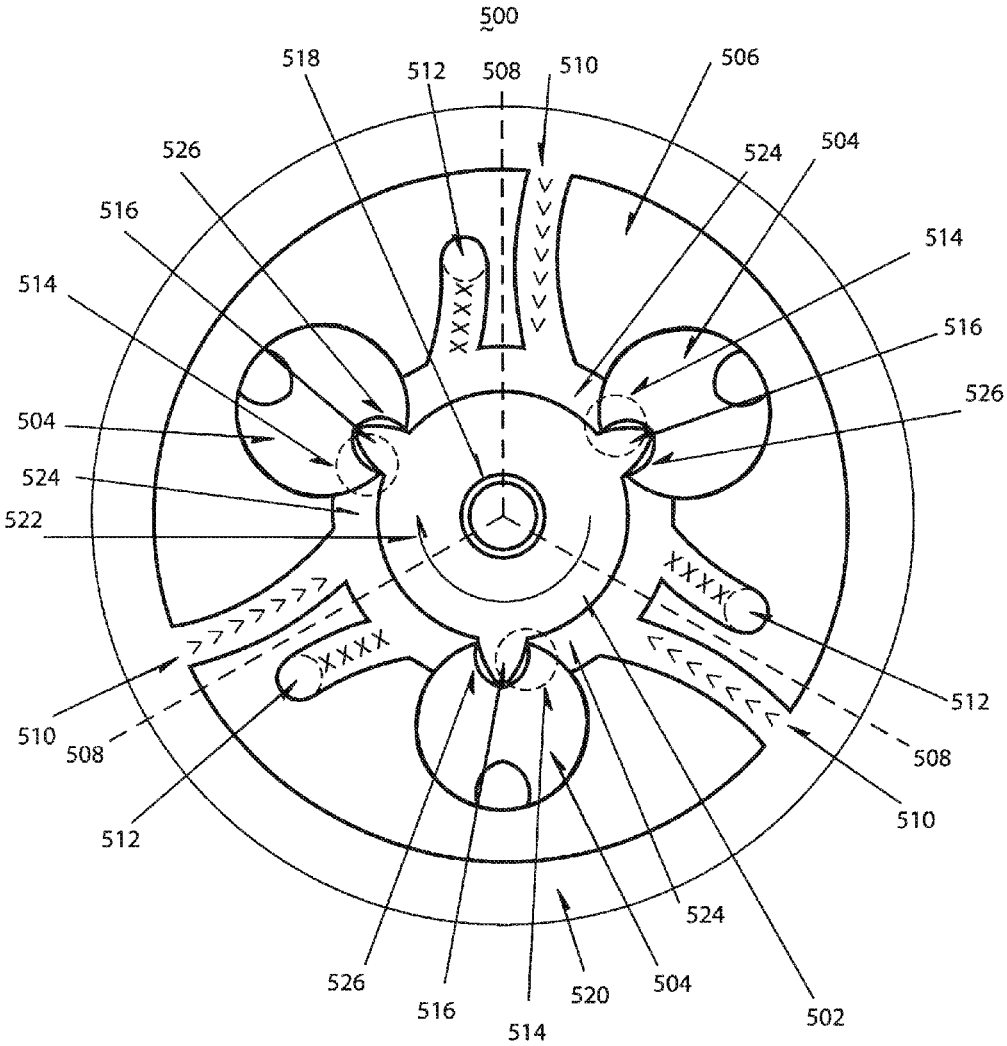
FIG. 6 shows a cross-section of another embodiment of an engine according to the present invention.
Figure 7A:
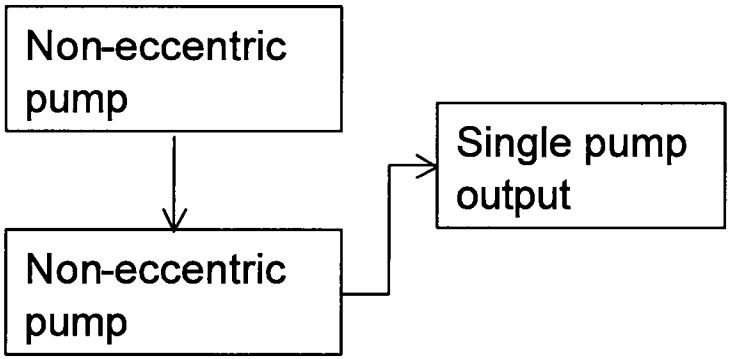
FIGS. 7A-D show schematically two cooperatively connected non-eccentric devices.
Figure 7B:
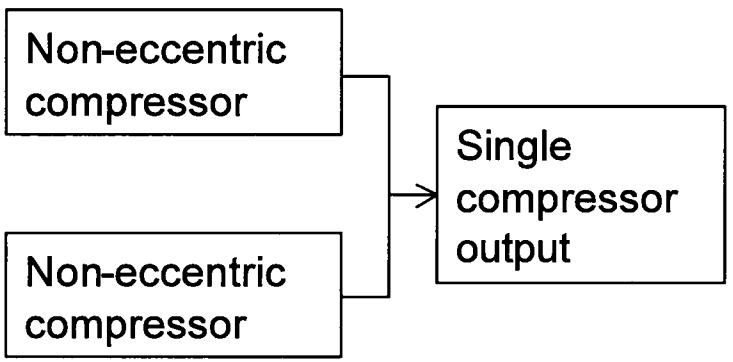
Figure 7C:
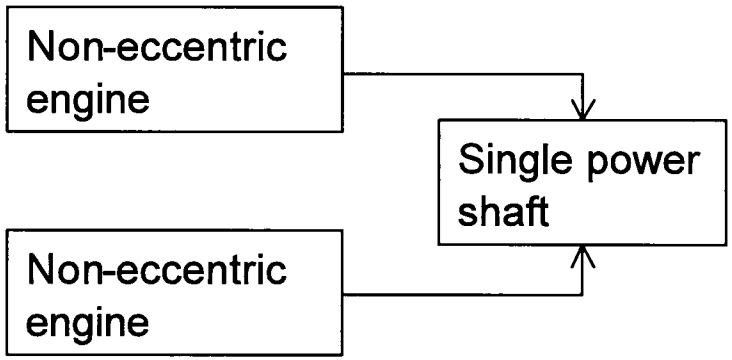
Figure 7D:
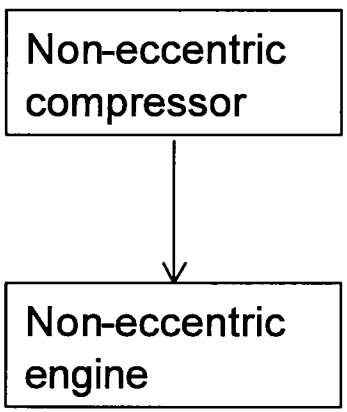

In a second embodiment of the engine aspect of the present invention, a single power rotor may be associated with more than two chamber rotors. As seen in FIG. 6, the engine 500 has a power rotor 502 associated with three combustion rotors 504 located in a rotor case 506. As discussed below, the isolation rotor is not used in this embodiment. The engine is divided into three identical operational zones, as roughly shown by the dotted lines 508. Each zone has a chamber rotor 504, an intake port 510, an exhaust port 512 and a spark plug 514. The power rotor 502 has three extensions 516 and a power output shaft 518. The intake port 510 is generally perpendicular to the axis of rotation of the power rotor. The exhaust port 512 has a portion that perpendicular and a portion parallel to the axis of rotation.

As discussed in more detail below, the engine 500 may also includes a pressurization ring 520 to evenly distribute pressurized intake gases around the rotor case 506. Other structures in the engine may be used to deliver the pressurized intake gases. The intake gases may be pressurized by any suitable device such as a supercharger, a turbocharger, a root blower and/or the compressor aspect of the present invention.

The operation of this embodiment is similar to the first embodiment of the engine aspect, but with some significant differences. As with the first embodiment, this engine has the same six zones. Rather then being spread across the entire perimeter of the power rotor, in the present embodiment, the six zones are roughly spread across only a third of the perimeter of the power rotor. This effectively increases the power density of the engine by replacing three power rotors, three combustion rotors and three valve rotors with one power rotor and three combustion rotors.

In place of the isolation rotor, pressurized intake gases are used to keep the intake gases separate from the exhaust gases. The pressurized intake gases effectively create barrier between each operational zone (roughly located where dotted line 508 is located). The pressurized barrier prevents exhaust gases from mixing with the intake gases, eliminating the need for the isolation rotor. The pressurized gases also turbo charge the engine.

Pressurized intake gases (shown as chevrons) are introduced at the intake ports 510. The curved intake ports direct the intake gases in the direction of rotation of the power rotor 502 (shown by arrow 522), thus creating the barrier between the intake and exhaust gases.

As in the other embodiments and aspects of this invention, the extension 516 compresses the intake gases as it sweeps them from the cavity 524 into the chamber 526 of the combustion rotor 504. Just before the power rotor 502 reaches TDC, the spark plug 514 ignites the intake gases. The combustion gases push the extension 516, transferring power to the shaft 518. The exhaust gases (shown by crosses) are vented out the exhaust port 512. As mentioned above, the pressurized bather of intake gases prevents the exhaust gases from mixing with the intake gases.

The spark plugs may be fired in sequence, but preferably the spark plugs are fired simultaneously, effectively tripling the power produced by the engine. Indeed, an additional power multiplier could be obtained through the use of additional extensions on the power rotor in combination with additional combustion rotors.

Also contemplated is combinatorial use of the pump, compressor and engine aspects of this invention. For example, several compressors may be serially connected such that the exhaust port of one is connected to intake port of the next, thus allowing gases to be compressed several times over. Also, several pumps acting on liquids can be serially connected to effectively act as "repeaters" to maintain a liquid flowing at a particular speed or under a particular pressure over a distance. Also, compressors could be used in parallel to greatly increase the rate at which compression/pumping could be accomplished. Likewise, several engines could be used in combination to generate a power for a single transmission, vehicle and/or machine. Furthermore, engines and compressors/pumps could be used in combination. For example, the power output shaft of the engine could be used to drive the power input shaft of the compressor. Also, the compressor could provide compressed intake gases to the engine or a pump could provide coolant fluid for the engine.

In another aspect, a heat exchange system is incorporated into or on to the engine. For example, the seal abutting the rotor face (if used) may have a heat exchange fluid pumped through it to transfer heat from the interior of the rotor case to a remote location where the heat is dissipated. More over, one or more thermoelectric devices may be used to dissipate heat from the rotors or rotor cases by placing the cool against the heat producing device or by generating electricity from the heat produced on the engine. In another embodiment, a fluid (e.g. oil, water, antifreeze, etc.) is pumped into the rotors near the shaft and allowed to circulate through the rotor and exit the rotor near it edge to dissipate heat from the rotor.

The present invention differs from known compressors and pumps in its operation. As discussed above, the rotors utilized in the present invention work together, i.e., they cooperate, to compress or to pump the fluid. Other components may also be part of the cooperative compression or pumping process, but unlike other devices, the rotors, at some point in their rotation, cooperate with each other to compress or pump the fluid being acted upon.

The present invention differs from known engines in several significant ways. Most importantly, the present engine is a pure non-eccentric engine, which significantly distinguishes it from a majority of known engines including piston and Wankel engines. As for turbine engines, which are also purely non-eccentric, the present invention is not a momentum turbine engine, but rather may be characterized as a pressure turbine engine. As discussed above, in known turbine engines, when the fan blades are prevented from rotating, the fluid merely continues to flow through the engine and no backpressure is created. In the present invention, if the power rotor is prevented from rotating, the intake gases cannot continue to flow through the engine and around the power rotor. This causes the intake gases to stack up and create backpressure. Hence, the characterization of the present engine as a pressure turbine engine as opposed to a momentum turbine engine. Likewise, the compressor of the present invention is also a pressure turbine device.

Given the significant differences between the present invention and known engines, easy comparison is not possible. A comparison among different engine types (turbine versus piston) is difficult because most engines are usually only compared within an engine type, i.e., one piston engine is compared to another piston engine. However, some comparison can be undertaken using some general properties of engines such as horsepower, fuel efficiency, emissions, weight, torque, and power density. Tables I & II show comparisons of several engines including an aircraft gas turbine engine, three marine piston engines and four theoretical engines according to the present invention (called Pressure Turbine Engines or PTEs). All the PTE would be built according to the embodiment shown in FIGS. 3-5. All weight calculations of the PTEs are based on using aluminum as the predominant material for the engine. The calculation of the weight of PTE II and PTE III would include accessories such as a gear train or a transmission. Calculations of horsepower in PTE III and PTE IV include the assumption that they would be turbocharged. While Table I compares physical characteristics, Table II compares operational characteristics. For known engine types, values for the attributes are drawn from published resources or calculated from published values. For the present inventive engines, the attribute values are calculated based on theory or from prototypes.

TABLE I

| Type | Weight (lb) | Displacement ($in^3$) | Size ($in^3$) | Parts | Emissions |
|---|---|---|---|---|---|
| Aircraft Gas Turbine | 210 | — | ~20664 | ~500 | High |
| Marine Diesel | 2500 | 641 | ~122400 | ~750 | Low |
| Marine Diesel* | 900 | 257 | ~30576 | ~750 | Low |
| Marine Gas | 940 | 350 | ~28380 | ~750 | Low |
| PTE I | 230 | 54 | ~3388 | ~12 | Very Low |
| PTE II | 300 | 54 | ~3388 | ~12 | Very Low |
| PTE III* | 350 | 54 | ~3388 | ~12 | Very Low |
| PTE IV* | 300 | 54 | ~3388 | ~12 | Very Low |

*These engines are turbocharged

From Table I it can be seen that the PTEs have several advantageous physical characteristics compared to known engines. For example, PTEs weigh slightly more than the gas turbine engine, but significantly less than the marine engines. With respect to displacement, the PTEs have a displacement that is several times smaller than the marine engines. The overall physical size of the PTEs is at least one order of magnitude smaller than the other engines, making the PTEs suitable for a larger number of applications. Also, several PTEs could be used in the space of one traditional engine. PTEs also have significantly fewer parts, which reduces costs of manufacturing assembly and maintenance, as well as dramatically increasing the reliability of the PTEs. While not wanting to be limited, it is believed that PTEs will be clean burning engines because of the long burn time possible in PTEs given that the pressure cavity lengthens during combustion. In addition, gas movement within the chamber gives turbulent flow (e.g. a high Reynolds number), which leads to more complete mixing and combustion of the fuel. Given the proper air/fuel mixture, essentially complete combustion can occur in the cavity between spark plug and the exhaust port. The length of the burn path ensures an essentially complete burn.

TABLE II

| Type | HP | RPM | Fuel Efficiency (lb/hr-hp) | Torque | Power-Displacement ($hp/in^3$) | Power Density (hp/lb) |
|---|---|---|---|---|---|---|
| Aircraft Gas Turbine | 380 | 30000 | 0.635 | 66 | — | 1.8 |
| Marine Diesel | 250 | 2000 | 0.374 | 670 | 0.37 | 0.10 |
| Marine Diesel* | 255 | 3600 | 0.42 | 372 | 0.99 | 0.28 |
| Marine Gas | 195 | 3500 | 0.35 | 337 | 0.56 | 0.21 |
| PTE I | 200 | 8000 | 0.35 | 130 | 4.6 | 0.86 |
| PTE II | 200 | 8000 | 0.35 | 130 | 4.6 | 0.67 |
| PTE III* | 400 | 16000 | 0.35 | 130 | 7.4 | 1.15 |
| PTE IV* | 400 | 16000 | 0.35 | 130 | 7.4 | 1.33 |

*These engines are turbocharged.

From Table II it can be seen that the PTEs have several advantageous operational characteristics compared to known engines. For example, despite their small weight, size and displacement, the PTEs have horsepower ratings that are higher than any other engine. The operational rpm (the speed at which the power rotor turns) of the PTEs is also significantly higher than the marine piston engines. The fuel efficiency of the PTEs is at least comparable to the known engines, if not slightly better than most of the known engines. The output torque of the PTEs is not as high as the output of the marine engines, but is nonetheless sufficient for a large variety of uses. The PTEs separate themselves from known engines when the size and weight of the PTEs is factored into the horsepower rating. As can be seen with respect to power-displacement, the PTEs are at least 4.6 times better than the best marine engine, and at least 12 times better than the worst marine engine. The power density rating of the PTEs shows similar results with respect to the marine engines. The PTEs are far more power dense than the marine engines. With respect to the gas turbine engine, the PTEs are less power dense; however, the PTEs have other attributes that make them desirable in view of gas turbine engines including smaller size, significantly fewer parts, lower emissions and better fuel efficiency.

One other important characteristic of the present PTEs is that there is a linear relationship between rpm and output horsepower; as the rpm increases, so does horsepower with a theoretical maximum limited only by the rpm of the power rotor. The horsepower rating of known engines is usually given at a specific rpm, and there is a maximum horsepower after which increasing the rpm will not increase the horsepower. Like the compressor, the PTEs have a linear relationship between rpm and amount of intake gases pump. Since all intake gases will be combusted, there is a linear correlation between amount of intake gases and the horsepower. Consequently, there is also a linear relationship between rpm and horsepower; as the rpm of the power rotor increases, so does the output horsepower of the present PTEs.

Figure 11:
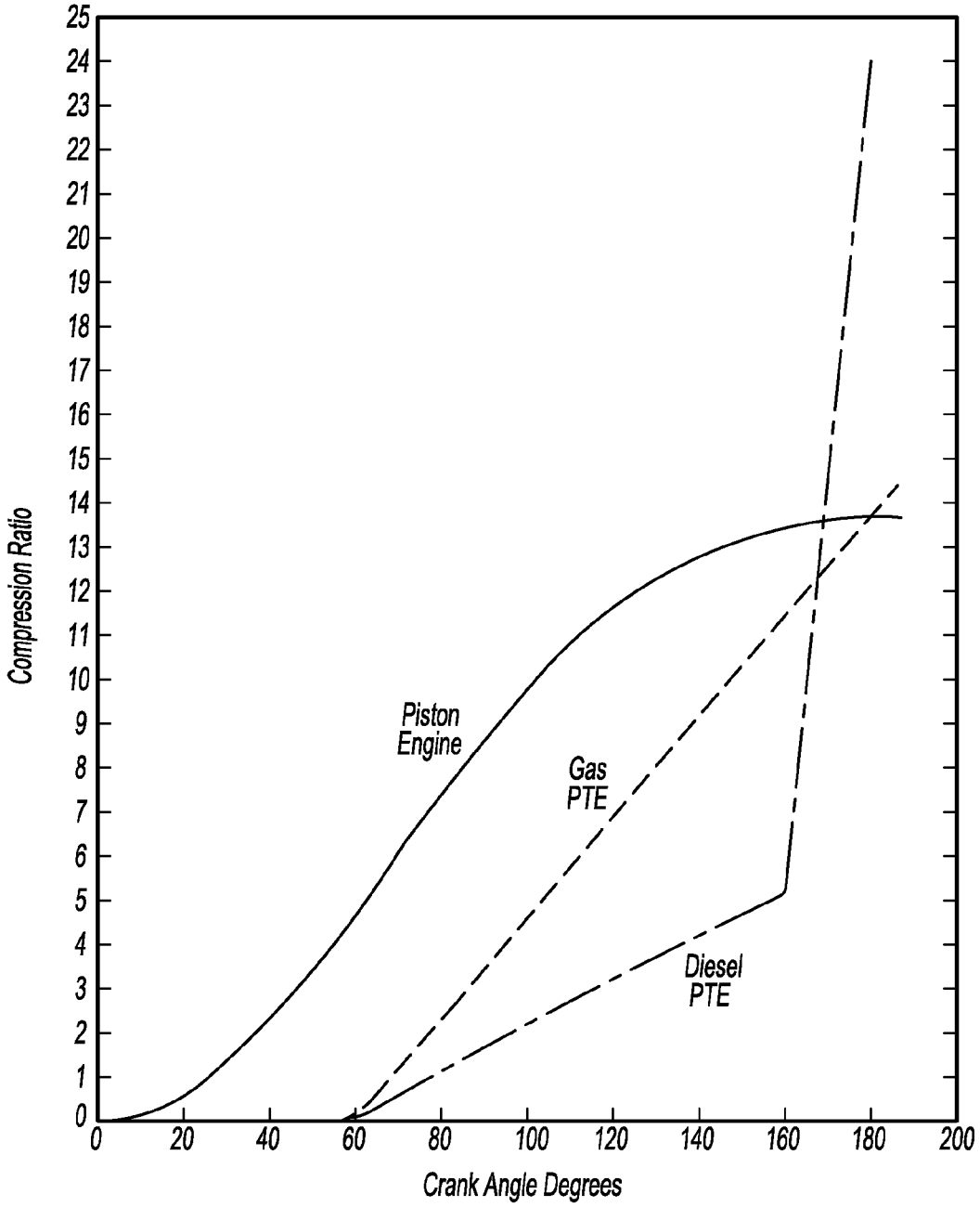
FIG. 11 shows the relationship between the compression ratio and crank angle for a piston engine, a non-eccentric engine using gas and a non-eccentric engine using diesel.

In another aspect of the engine of the present invention, the PTEs have a non-linear compression profile. FIG. 11 also shows a non-linear compression profile for a piston engine. Need to clarify this terminology. As the extension passes the intake port, compression is linear and a function of the degrees of rotation between the extension and the chamber rotor. The non-linear portion of the compression occurs as the extension enters the chamber. The shape of the extension and the size of the chamber control the amount of compression within the chamber. For example, a compression ratio of 6:1 may be present before the extension enters the chamber, but increases dramatically to a ratio of 24:1 when the extension is in the chamber. Since the extension enters the chamber in the final 20 degrees of rotation (e.g. when the extensions and chambers 120 degrees apart), the compression ratio is almost one unit of compression per degree of rotation as shown in FIG. 11. The compression ratio goes from about 6 to about 24 over the last 20° or about 9/10ths of a unit per degree. This non-linear compression profile is completely different than that of a piston/crankshaft engine. It also allows for homogeneous charge combustion ignition (HCCI) to occur, which in turn eliminates the need for a pressure fuel injection system and related components that directly inserts fuel into the combustion chamber.

In yet another mode of operation, the engines of the present invention may be operated as a detonation engine. During combustion, the non-eccentric engine produces less than ½ of the force against the bearings as compared to a piston engine because the combustion is contained in at least a four sided chamber (e.g. top=chamber nadir, bottom=extension, right=one chamber wall, left=other chamber wall) verses the two sided chamber found a piston engine (i.e., the piston face and head). The chamber shape and the extension shape permit the engine to be used as a detonation engine. A detonation engine burns all the compressed gases almost simultaneously in the chamber, thus producing a sharp rise in pressure, which can immediately be used to generate torque. This almost simultaneous burning of all the compressed gases is useful to permit the engine to operate at very high rpms. Slower burning compressed gases would degrade the efficiency of the engine and sap the engine of power and toque, particularly when the engine is running at 20,000 rpm and up.

It will be further appreciated that functions or structures of a plurality of components or steps may be combined into a single component or step, or the functions or structures of one-step or component may be split among plural steps or components. The present invention contemplates all of these combinations. Unless stated otherwise, dimensions and geometries of the various structures depicted herein are not intended to be restrictive of the invention, and other dimensions or geometries are possible. Plural structural components or steps can be provided by a single integrated structure or step. Alternatively, a single integrated structure or step might be divided into separate plural components or steps. In addition, while a feature of the present invention may have been described in the context of only one of the illustrated embodiments, such feature may be combined with one or more other features of other embodiments, for any given application. It will also be appreciated from the above that the fabrication of the unique structures herein and the operation thereof also constitute methods in accordance with the present invention. The present invention also encompasses intermediate and end products resulting from the practice of the methods herein. The use of "comprising" or "including" also contemplates embodiments that "consist essentially of" or "consist of" the recited feature.

The explanations and illustrations presented herein are intended to acquaint others skilled in the art with the invention, its principles, and its practical application. Those skilled in the art may adapt and apply the invention in its numerous forms, as may be best suited to the requirements of a particular use. Accordingly, the specific embodiments of the present invention as set forth are not intended as being exhaustive or limiting of the invention. The scope of the invention should, therefore, be determined not with reference to the above description, but should instead be determined with reference to the appended claims, along with the full scope of equivalents to which such claims are entitled. The disclosures of all articles and references, including patent applications and publications, are incorporated by reference for all purposes.

What is claimed is:

1. An apparatus, comprising:

at least one chamber rotor, located on a first shaft, the chamber rotor including at least one chamber with a first and second chamber walls;

at least one extension rotor, located on a second shaft, the extension rotor including at least one extension with first and second extension walls; and a rotor case that houses the rotors, wherein, during rotation of the rotors, the chamber wall and extension wall seal against one another to develop compression of a fluid in the at least one chamber, wherein the first and second extension walls have shapes determined by repeatedly solving equations:

$$X=[A+C]\ \mathrm{Cos}(\mathrm{Theta}-\mathrm{Theta_1})-[C]\ \mathrm{Cos}(([A+C]/[C])\mathrm{Theta}),\ \text{and}$$

$$Y=[A+C]\ \mathrm{Sin}(\mathrm{Theta}-\mathrm{Theta_1})-[C]\ \mathrm{Sin}(([A+C]/[C])\mathrm{Theta}),$$

where A=chamber rotor radius, C=extension rotor radius, Theta_1 corresponds to a selected compression ratio, Theta has a starting value of zero radians and Theta is first positively incremented and then negatively incremented.

2. The apparatus of claim 1 wherein the first and second chamber walls have shapes determined by repeatedly solving equations:

$$X=[A+C]\ \mathrm{Cos}(\mathrm{Theta})-[C+B]\ \mathrm{Cos}(([A+C]/[C])\mathrm{Theta}),\ \text{and}$$

$$Y=[A+C]\ \mathrm{Sin}(\mathrm{Theta})-[C+B]\ \mathrm{Sin}(([A+C]/[C])\mathrm{Theta}),$$

where A=chamber rotor radius, B=chamber depth, C=extension rotor radius, Theta has a starting value of zero radians and Theta is first positively and then negatively incremented.

3. The apparatus of claim 2 wherein during rotation, the extension and the rotor case seal against one another to develop compression of a fluid in a pressure cavity that is transiently formed between the extension rotor and the rotor case.

4. The apparatus of claim 3 further comprising one or more interlocking teeth and one or more corresponding interlocking tooth spaces.

5. The apparatus of claim 4 wherein at least one interlocking tooth is located on the chamber rotor and at least one interlocking tooth space is located on the extension rotor.

6. The apparatus of claim 5 wherein a gap exists between the extension and the chamber when the extension is ±5° top dead center.

7. The apparatus of claim 4 wherein the seal between the chamber wall and the extension wall represents a space of less than about $5/10000^{th}$ of an inch.

8. The apparatus of claim 7 further comprising an ignition source.

9. The apparatus of claim 8 wherein the compression ratio of the apparatus is between about 20:1 and about 30:1.

10. The apparatus of claim 3 wherein the seal between the chamber wall and the extension wall represents a space of less than about $1/1000^{th}$ of an inch.

11. The apparatus of claim 10 wherein the extension comprises a plateau in place of an extension apex to form the gap.

12. An apparatus, comprising:

at least one chamber rotor, located on a first shaft, the chamber rotor including at least one chamber with a first and second chamber walls and at least one interlocking tooth;

at least one extension rotor, located on a second shaft, the extension rotor including at least one extension with first and second extension walls and at least one interlocking tooth space; and a rotor case that houses the rotors, wherein, during rotation of the rotors, the chamber wall and extension wall seal against one another to develop compression of a fluid in the at least one chamber, wherein the first and second extension walls have shapes determined by repeatedly solving equations:

$$X=[A+C]\ \mathrm{Cos}(\mathrm{Theta}-\mathrm{Theta_1})-[C]\ \mathrm{Cos}(([A+C]/[C])\mathrm{Theta}),\ \text{and}$$

$$Y=[A+C]\ \mathrm{Sin}(\mathrm{Theta}-\mathrm{Theta_1})-[C]\ \mathrm{Sin}(([A+C]/[C])\mathrm{Theta}),$$

where A=chamber rotor radius, C=extension rotor radius, Theta_1 corresponds to a selected compression ratio, Theta has a starting value of zero radians and Theta is first positively incremented and then negatively incremented, and wherein the first and second chamber walls have shapes determined by repeatedly solving equations:

$$X=[A+C]\ \mathrm{Cos}(\mathrm{Theta})-[C+B]\ \mathrm{Cos}(([A+C]/[C])\mathrm{Theta}),\ \text{and}$$

$$Y=[A+C]\ \mathrm{Sin}(\mathrm{Theta})-[C+B]\ \mathrm{Sin}(([A+C]/[C])\mathrm{Theta}),$$

where A=chamber rotor radius, B=chamber depth, C=extension rotor radius, Theta has a starting value of zero radians and Theta is first positively and then negatively incremented.

* * * * *